US006365008B1

(12) United States Patent
Goto et al.

(10) Patent No.: US 6,365,008 B1
(45) Date of Patent: Apr. 2, 2002

(54) ELECTRIC-DISCHARGE SURFACE TREATMENT METHOD, AND APPARATUS AND ELECTRODE FOR CARRYING OUT THE METHOD

(75) Inventors: Akihiro Goto; Toshio Moro, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/663,943

(22) Filed: Sep. 18, 2000

Related U.S. Application Data

(63) Continuation of application No. PCT/JP98/01088, filed on Mar. 16, 1998.

(51) Int. Cl.[7] ..... B01J 19/08
(52) U.S. Cl. ..... 204/164; 422/186.03
(58) Field of Search ..... 204/164; 422/186.04

(56) References Cited

U.S. PATENT DOCUMENTS 5,858,479 A 1/1999 Saito et al. ..... 427/580
6,086,684 A 7/2000 Saito et al. ..... 148/220

FOREIGN PATENT DOCUMENTS

| | | | |
|---|---|---|---|
| JP | 8-257841 | 10/1996 | ..... B23H/9/00 |
| JP | 8-300227 | 11/1996 | ..... B23H/9/00 |
| JP | 9-192937 | 7/1997 | ..... B23H/9/00 |
| JP | 10-337617 | 12/1998 | ..... B23H/9/00 |

*Primary Examiner*—Kishor Mayekar
(74) *Attorney, Agent, or Firm*—Sughrue Mion, PLLC

(57) ABSTRACT

An electric-discharge surface treatment method in which a compressed powder electrode obtained by compression-molding metal powder, metal compound powder, or ceramics powder, or a metal electrode is used as an electrode, and pulsed electric discharge is generated between the electrode and a material to be treated so that a hard coating composed of an electrode material or a substance obtained by reaction of the electrode material in response to energy of the electric discharge is formed on a surface of the material to be treated by the energy of the electric discharge; wherein the method uses an electrode in which carbon or graphite powder, or a substance for producing carbon in response to energy of electric discharge is mixed into the electrode material.

9 Claims, 5 Drawing Sheets

ELECTRIC-DISCHARGE SURFACE TREATMENT METHOD, AND APPARATUS AND ELECTRODE FOR CARRYING OUT THE METHOD

This application is a continuation of PCT /JP98/01088, filed Mar. 16, 1998.

BACKGROUND OF THE INVENTION

1. Field of the Invention

The present invention relates to the improvement of an electric-discharge surface treatment method in which pulsed electric discharge is generated between an electrode and a material to be treated, and a hard coating comprising an electrode material or a substance formed by the reaction of the electrode material in response to the electric discharge energy is formed on the surface of the material to be treated. The invention further relates to the improvement of an apparatus and an electrode for carrying out the method.

2. Description of the Related Art

There has been already known a technique in which the surface of a metal material is coated by in-liquid electric discharge so that corrosion resistance and abrasion resistance are given to the metal material. The main point of the technique is as follows. That is, in-liquid electric discharge is performed with an electrode compression-molded out of a mixture of powder of tungsten carbide WC and cobalt Co, so that the electrode material is deposited on a material to be treated. Then, remelting electric-discharge treatment is performed with another electrode such as a copper electrode, a graphite electrode, or the like, so that higher hardness and higher adhesion force are obtained.

Description will be made below about the aforementioned conventional technique with reference to FIG. 5. Electric-discharge treatment is performed in liquid by use of a compressed tungsten carbide-cobalt WC—Co mixture powder electrode, so that tungsten carbide-cobalt WC—Co is deposited (primary treatment). Next, remelting treatment (secondary treatment) is performed with an electrode'such as a copper electrode which is not consumed so much. With the deposition in the primary treatment, the structure has a Vickers hardness of about Hv=1,410 and has many cavities. However, with the remelting treatment in the secondary treatment, the cavities in the coating layer are eliminated, and the hardness is also improved to be Hv=1,750.

According to this method, a coating layer which is hard and excellent in adhesion can be obtained for a steer material, but, for the surface of a sintered material such as sintered hard alloy, it is difficult to form a coating layer having a solid adhesion force.

However, through the research of the present inventors, it was proved that if a material such as titanium Ti or the like, for forming hard carbide, was used as an electrode and electric discharge was generated between the electrode and a metal material as a material to be treated, a solid hard film could be formed, without any process of remelting treatment, on the metal surface which was the material to be treated. It is understood that this was because the electrode material consumed by the electric discharge reacted with carbon C which was a component of treatment liquid so that titanium carbide TiC was produced. Further, it was proved that when a compressed powder electrode of metal hydride such as titanium hydride $TiH_2$, or the like, was used, and electric discharge was generated between the electrode and a metal material which was a material to be treated, a hard film could be formed more quickly and more excellent in adhesion than in the case where a material such as titanium Ti, or the like, was used. Further, it is known that if a compressed powder electrode in which hydride such as titanium hydride $TiH_2$ or the like is mixed with another metal or ceramic, is used, and electric discharge is generated between the electrode and a metal material which is a material to be treated, a hard coating having various properties with respect to the hardness, abrasion resistance, etc. can be formed quickly. This method is disclosed in JP-A-9-192937.

According to the aforementioned background-art electric-discharge surface treatment method, the material of an electrode reacts with carbon C formed by decomposition of a component of the treatment liquid by heat due to electric discharge so that a hard carbide coating is formed on a material to be treated. In this method, however, there has been a problem that the quantity of carbon C to be supplied has a limit so that the hardness of the coating does not increase satisfactorily.

SUMMARY OF THE INVENTION

The present invention was achieved to solve the foregoing problems. It is an object of the present invention to provide an electric-discharge surface treatment method for enhancing the hardness of a hardcoating formed on a material to be treated; and an apparatus and an electrode for carrying out the method.

In addition it is another object of the present invention to provide an electric-discharge surface treatment method which uses water carefree with fire; and an apparatus and an electrode for carrying out the method.

In order to achieve the above objects, according to the first aspect of the present invention, there is provided an electric-discharge surface treatment method in which a compressed powder electrode obtained by compression-molding of metal powder, metal compound powder, or ceramic powder, or a metal electrode is used as an electrode, and pulsed electric discharge is generated between the electrode and a material to be treated so that a hard coating composed of an electrode material or a substance obtained by reaction of the electrode material in response to energy of the electric discharge is formed on a surface of the material to be treated; characterized in that the method uses an electrode in which carbon or graphite powder, or a substance for producing carbon in response to energy of electric discharge is mixed into the electrode material.

Further, according to a second aspect of the present invention, there is provided, in an apparatus for electric-discharge surface treatment in which pulsed electric discharge is generated between an electrode and a material to be treated so that a hard coating comprising an electrode material or a substance obtained by reaction of the electrode material in response to energy of the electric discharge is formed on a surface of the material to be treated, an electrode for electric-discharge surface treatment characterized in that the electrode comprises a metal, a metal compound, or a mixture in which carbon or graphite powder, or a substance for producing carbon in response to energy of electric discharge is mixed into ceramics powder.

Further, according to a third aspect of the present invention, there is provided an electric-discharge surface treatment method in which a compressed powder electrode obtained by compression-molding of metal powder, metal compound powder, or ceramic powder, or a metal electrode is used as an electrode, and pulsed electric discharge is generated between the electrode and a material to be treated so that a hard coating composed of an electrode material or a substance obtained by reaction of the electrode material in response to energy of the electric discharge is formed on a surface of the material to treated; characterized in that the method uses an electrode in which carbon, graphite, or a substance for producing carbon in response to energy of electric discharge is mixed into the metal material.

According to a fourth aspect of the present invention, the electric-discharge surface treatment method is characterized in that a material of the electrode is titanium powder or a ititanium compound.

According to a fifth aspect of the present invention, the electrode for the electric-discharge surface treatment is characterized in that the material of the electrode is titanium powder or a titanium compound.

According to a sixth aspect of the present invention, there is provided an electric-discharge surface treatment apparatus in which a compressed powder electrode obtained by compression-molding of metal powder, metal compound powder, or ceramic powder, or a metal electrode is used as an electrode, and pulsed electric discharge is generated between the electrode and a material to be treated so that a hard coating comprising an electrode material or a substance obtained by reaction of the electrode material in response to energy of the electric discharge is formed on a surface of the material to be treated, characterized in that the apparatus comprises: an electrode in which carbon or graphite powder, or a substance for producing carbon in response to energy of electric discharge is mixed into metal powder, metal compound powder, or ceramic powder; a power supply unit for generating pulsed electric discharge between the electrode and a material to be treated; and treatment liquid supply means for supplying water as treatment liquid between the electrode and the material to be treated.

DETAILED DESCRIPTION OF THE PREFERRED EMBODIMENTS

Next, embodiments will be described below about the present invention.

Embodiment 1.

Figure 1:
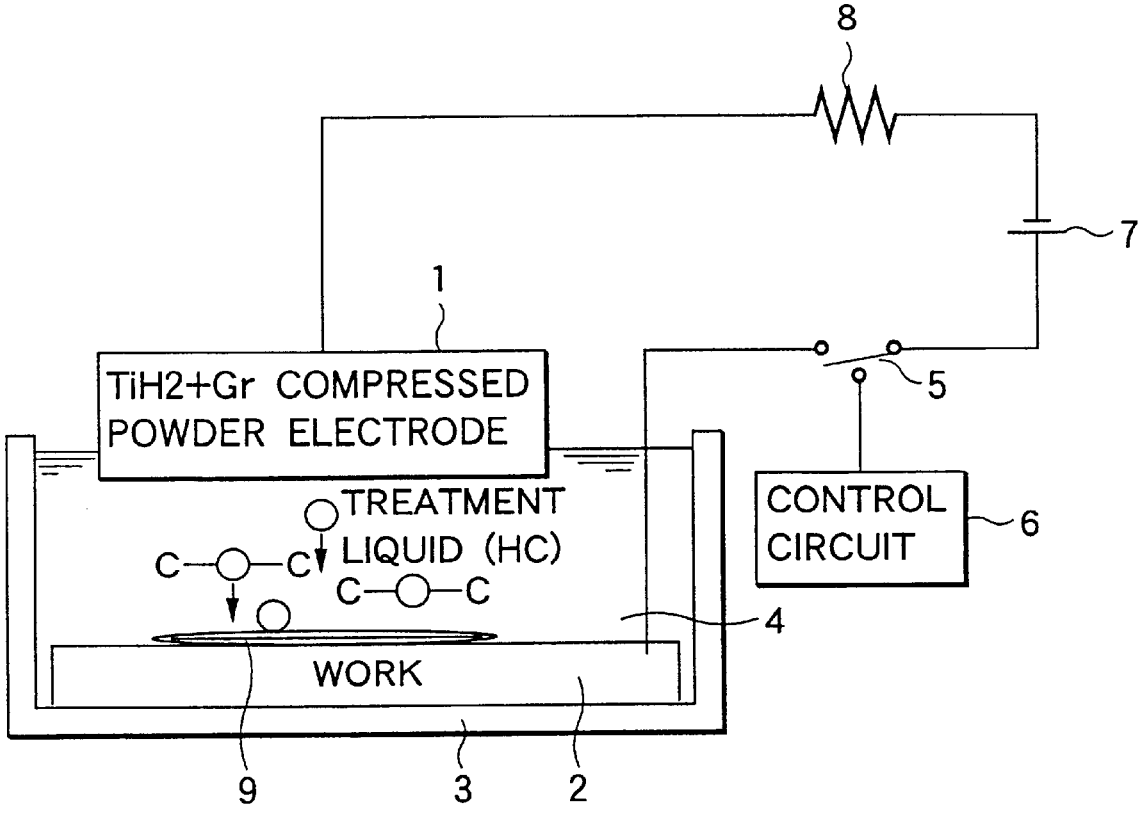
FIG. 1 is a view for explaining a first embodiment of the present invention.

FIG. 1 is a configuration view showing the concept of an electric-discharge surface treatment apparatus according to the first embodiment of the present invention.

In FIG. 1, the reference numeral 1 represents an electrode of compressed powder of titanium hydride $TiH_2$and graphite Gr; 2, a material to be treated; 3, a treatment tank; 4, treatment liquid; 5, a switching element for switching a voltage and a current to be applied to the compressed powder electrode 1 and the material to be treated 2; 6, a control circuit for controlling ON/OFF of the switching element 5; 7, a power supply; 8, a resistor; and 9, a hard coating formed on the material to be treated 2.

Next, detailed description will be made about a surface treatment method by using the electric-discharge surface treatment apparatus according to this embodiment.

Pulsed electric discharge is generated between the compressed powder electrode 1 and the material to be treated 2 while the compressed powder electrode 1 and the material to be treated 2 are controlled to have a proper gap (10 $\mu$m to several tens of $\mu$m) therebetween (a driving system for position control is not shown). Then, the compressed powder electrode 1 is consumed by the electric discharge energy, and carbon C which is a component of the treatment liquid and titanium Ti which is a component of the electrode, react with each other so as to form hard titanium carbide TiC. Thus, the hard titanium carbide TiC adheres to the material to be treated 2 so as to form the hard coating 9. At this time, if carbon powder such as graphite Gr powder (black lead powder) or the like is mixed into the electrode, a large quantity of carbon reactive with titanium Ti can be supplied, so that an entire titanium carbide TiC coating can be formed without leaving any unreacted titanium Ti behind. In the case where titanium hydride $TiH_2$ is used as titanium Ti powder as shown in FIG. 1, the hardness of the coating is about 1,500 HV in terms of Vickers hardness when treatment is performed with a compressed powder electrode of only titanium hydride $TiH_2$. When graphite powder is added to the compressed powder electrode, the hardness reaches about 3,000 HV so that the coating can be made extremely hard, substantially as hard as titanium carbide TiC.

Also when another material is mixed into the electrode, the effect of enhancement of the hardness due to addition of graphite powder to the electrode is recognized similarly.

Embodiment 2.

Figure 2:
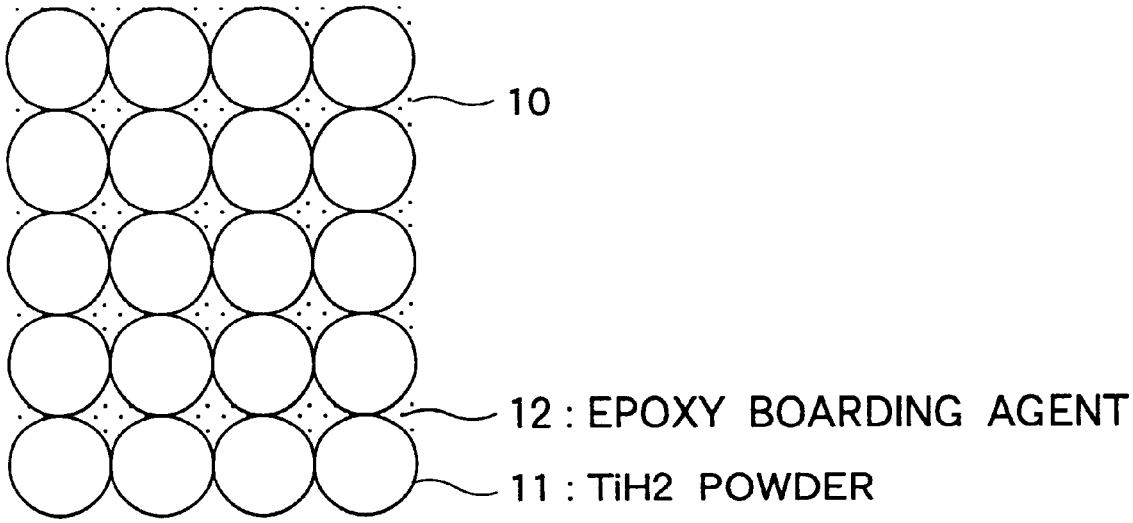
FIG. 2 is a view for explaining a second embodiment of the present invention.

FIG. 2 is a configuration view showing the concept of an electric-discharge surface treatment electrode according to a second embodiment of the present invention.

In FIG. 2, the reference numeral 11 represents powder of titanium hydride $TiH_2$; and 12, a material such as an epoxy bonding agent, or the like, which is to produce carbon in response to electric discharge energy.

Next, detailed description will be made about a surface treatment method with the electric-discharge surface entreatment electrode according to this embodiment.

Pulsed electric discharge is generated between a compressed powder electrode 10 and a material to be treated while the compressed powder electrode 10 and the material to be treated are controlled to have a proper gap (10 $\mu$m to several tens of $\mu$m) therebetween (no driving system for position control is shown in the drawing). Then, the compressed powder electrode 10 is consumed by the electric discharge energy. Then, carbon C which is a component of the treatment liquid and titanium Ti which is a component of the electrode, react with each other so as to form hard titanium carbide TiC. Thus, the hard titanium carbide TiC adheres to the material to be treated so as to form a hard coating. However, titanium Ti in the electrode cannot form titanium carbide TiC entirely. This is because the quantity of carbon supplied from the treatment liquid is smaller than the quantity of titanium Ti released from the electrode. Therefore, a material for producing carbon in response to electric discharge energy, for example, an epoxy bonding agent 12 is mixed into the electrode as a carbon supply source. The epoxy bonding agent or the like is a substance composed of carbon atoms C, hydrogen atoms H, oxygen atoms O, etc. The substance is decomposed by electric discharge energy so that the hydrogen atoms chiefly form water $H_2O$ or hydrogen gas $H_2$, the oxygen atoms form water $H_2O$ or carbon dioxide $CO_2$, and the carbon atoms form carbon dioxide $CO_2$ or carbon C. Since the carbon C produced at this time is used to react with titanium Ti in the electrode so as to form titanium carbide TiCi the carbon C is useful to form a hard coating.

Also in the case where another material is mixed into the electrode, the effect that the hardness is enhanced by adding an epoxy bonding agent or the like for producing carbon in response to electric discharge energy is recognized. similarly. Also by mixing paraffin or the like into the electrode, there is a similar effect, and there is another effect that the electrode can be molded firmly.

Embodiment 3.

Figure 3:
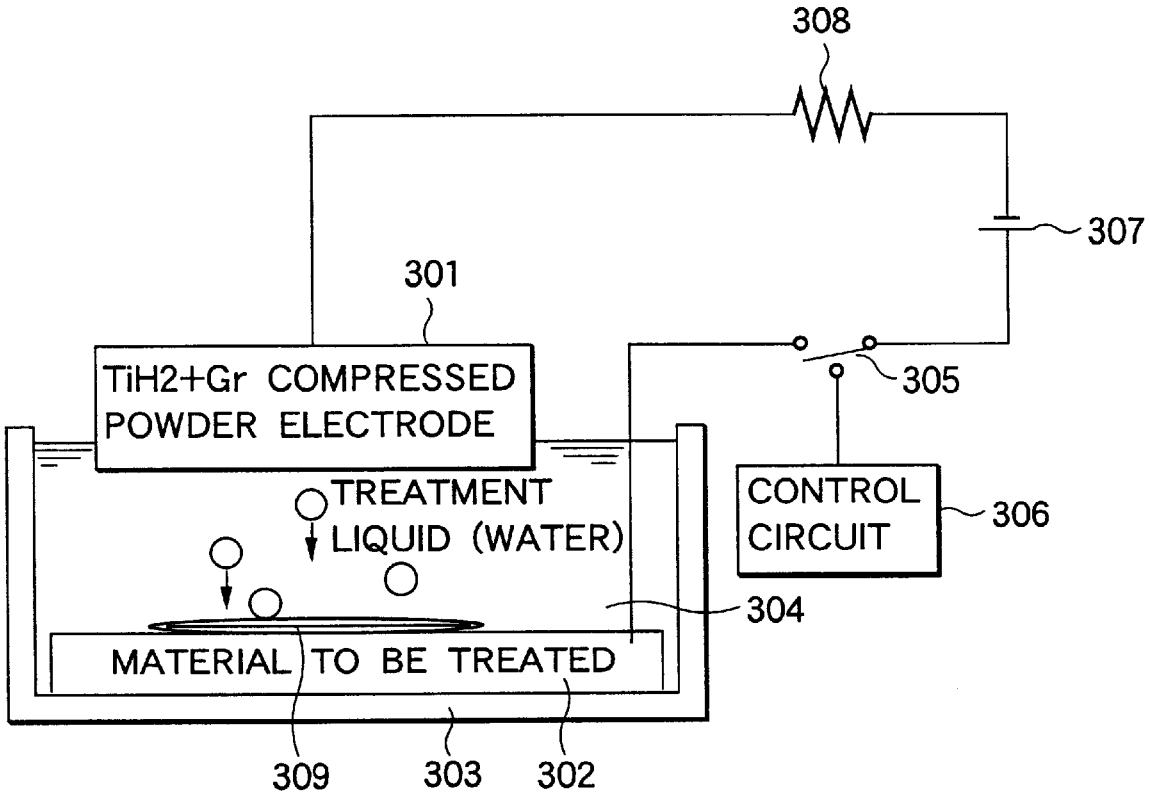
FIG. 3 is a view for explaining a third embodiment of the present invention.

FIG. 3 is a configuration view showing the concept of an electric-discharge surface treatment apparatus according to a third embodiment of the present invention.

In FIG. 3, the reference numeral 301 represents a compressed powder electrode of titanium hydride $TiH_2$ and graphite Gr; 302, a material to be treated; 303, a treatment tank; 304, water as treatment liquid; 305, a switching element for switching a voltage and a current to be applied to the compressed powder electrode 301 and the material to be treated 302; 306, a control circuit for controlling ON/OFF of the switching element 305; 307, a power supply; 308, a resistor; and 309, a hard coating formed on the material to be treated 302.

Next, detailed description will be made about a surface treatment method by using the electric-discharge surface treatment apparatus according to this embodiment.

Pulsed electric discharge is generated between the compressed powder electrode 301 and the material to be treated 302 while the compressed powder electrode 301 and the material to be treated 302 are controlled to have a proper gap (10 $\mu$m to several tens of $\mu$m) therebetween (a driving system for position control is not shown). Then, the compressed powder electrode 301 is consumed by the electric discharge energy. At the same time, carbon (graphite) C and titanium Ti produced by the decomposition of titanium hydride $TiH_2$, react with each other in the electrode so as to form hard titanium carbide TiC. Thus, the hard titanium carbide TiC adheres to the material to be treated 302 so as to form the hard coating 309.

According to the background-art electric-discharge surface treatment method, an electrode material reacts with carbon C produced by the thermal decomposition of a component of treatment liquid in response to electric discharge, so that a hard carbide coating is formed on a material to be treated. In this method, however, oil is required to be used as the treatment liquid so that there is a possibility of fire. Accordingly, the method has been often restricted as to how to use. Therefore, a carbon material is mixed into the electrode material so that metal and carbon are made to react with each other in the electrode. Thus, even if water is used as the treatment liquid, a hard carbide coating can be formed.

Embodiment 4.

Figure 4:
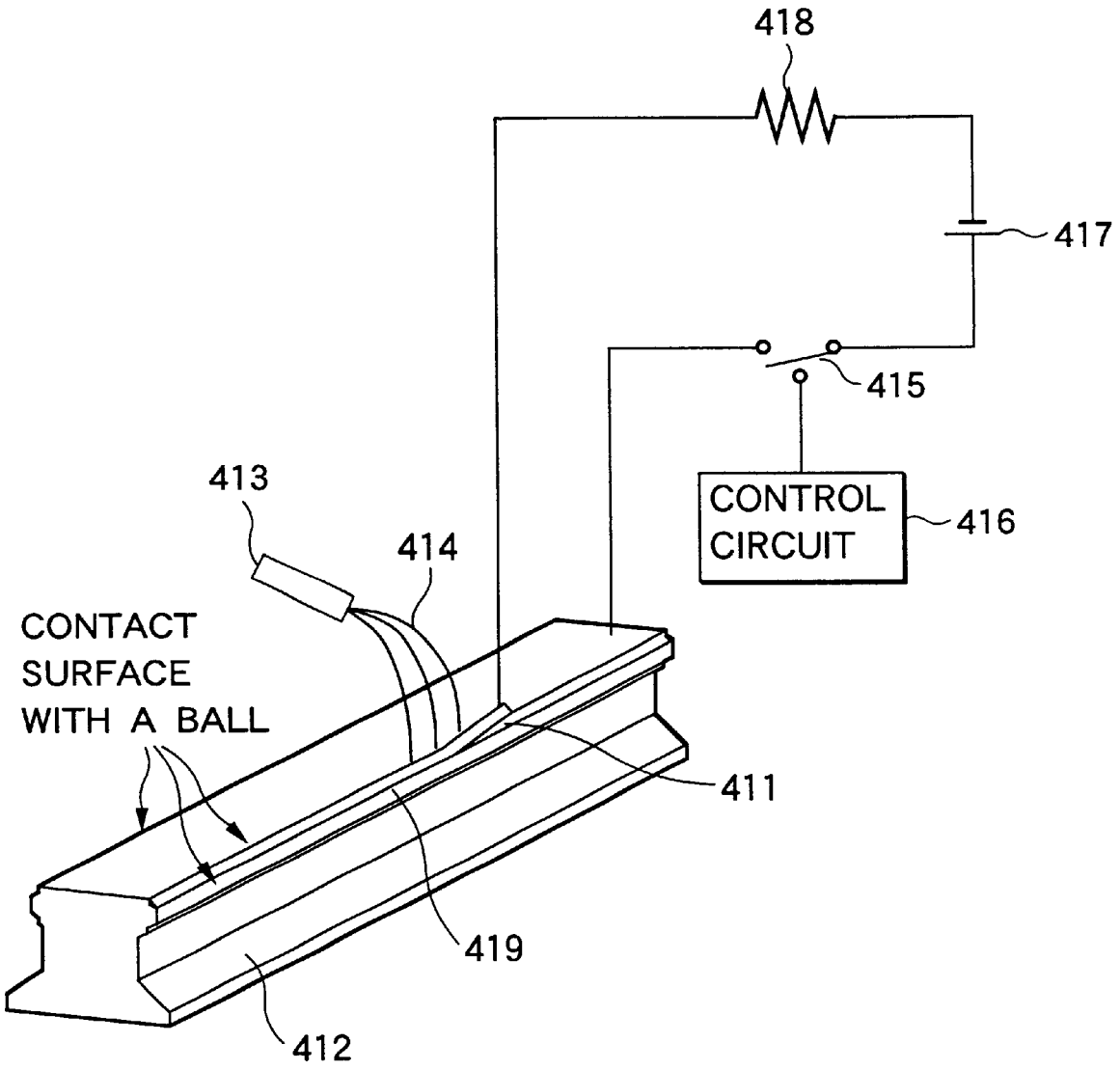
FIG. 4 is a view for explaining a fourth embodiment of the present invention.
Figure 5:
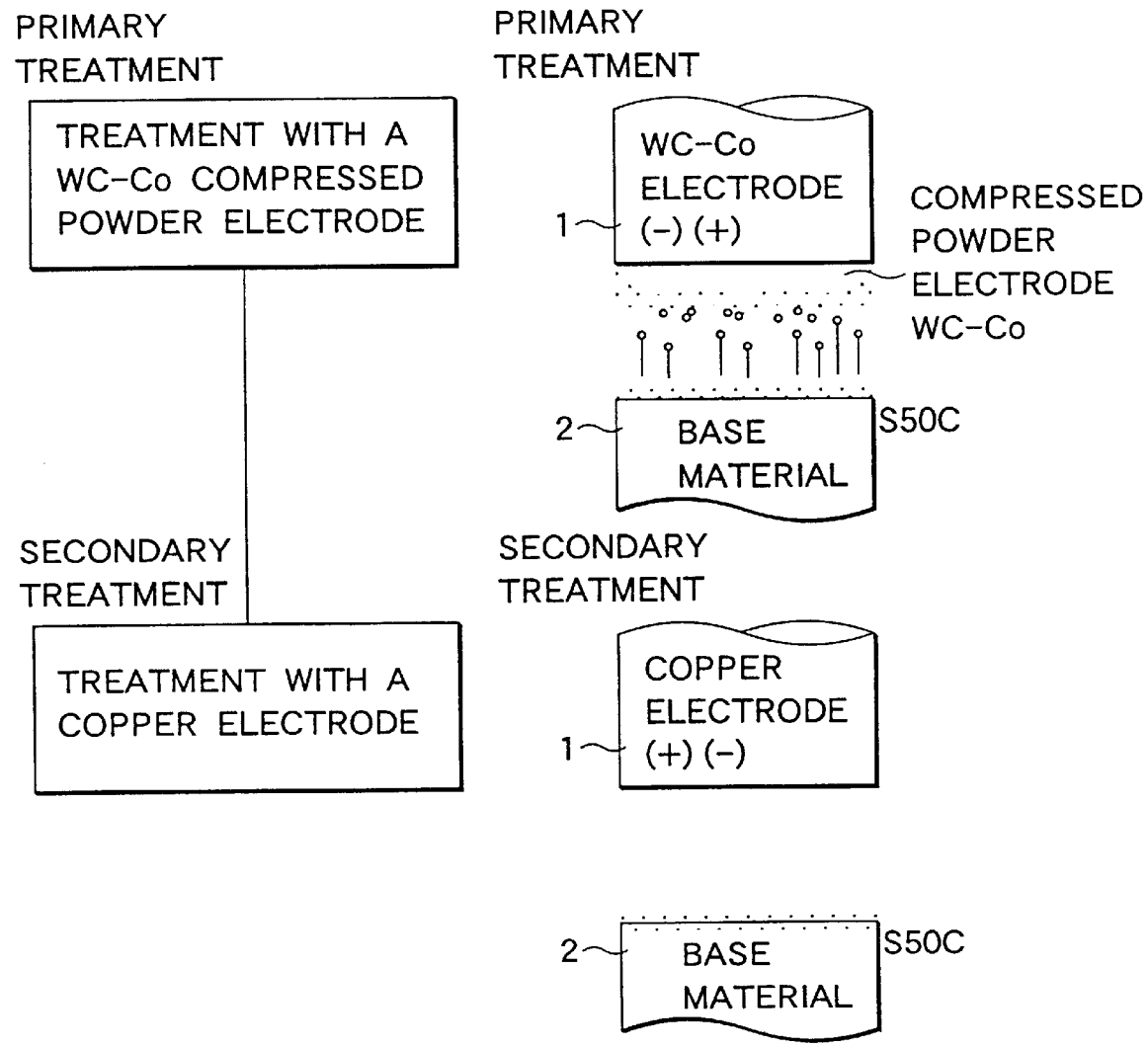
FIG. 5 is an explanatory view showing a background-art example.

FIG. 4 is a configuration view showing the concept of an electric-discharge surface treatment electrode according to a fourth embodiment of the present invention, and showing the state where treatment is performed upon a linear guide.

In FIG. 4, the reference numeral 411 represents a compressed powder electrode of titanium hydride $TiH_2$ and graphite Gr; 412, a linear guide which is a material to be treated; 413, a nozzle for discharging water which is treatment liquid; 414, water which is treatment liquid; 415, a switching element for switching a voltage and a current to be applied to the compressed powder electrode 411 and the material to be treated 412; 416, a control circuit for controlling ON/OFF of the switching element 415; 417, a power supply; 418, a resistor; and 419, a hard coating formed on the linear guide 412.

Next, detailed description will be made about a surface treatment method with the electric-discharge surface treatment electrode according to this embodiment.

As the compressed powder electrode 411 and the linear guide 412 are controlled to have a proper gap (10 $\mu$m to several tens of $\mu$m) therebetween (a driving system for position control is not shown), the compressed powder electrode 411 and the linear guide 412 are sprayed with the water 414 while pulsed electric discharge is generated therebetween. Then, the compressed powder electrode 411 is consumed by the electric discharge energy while reacting with carbon so as to form carbide. Thus, a hard film can be formed on thee surface of the linear guide 412. According to the background-art electric-discharge surface treatment method, an electrode material reacts with carbon C produced by the decomposition of a component of treatment liquid heat due to electric discharge, so that a hard carbide coating is formed on a material to be treated. In this method, however, oil is required to be used as the treatment liquid so that there is a possibility of fire. Accordingly, the method has been often restricted as to how to use. Therefore, a carbon material is mixed into the electrode material so that metal and carbon are made to react with each other in the electrode. Thus, even if water is used as the treatment liquid, a hard carbide coating can be formed. In the case of this embodiment, treatment to spray treatment liquid, which was hitherto impossible, is allowed.

As has been described above, according to the electric-discharge surface treatment method according to the first invention, at hard coating can be formed on the surface of a material to be treated.

In addition, when the electric-discharge surface treatment electrode according to the second invention is used for electric-discharge surface treatment, a hard coating can be formed on the surface of a material to be treated.

In addition, according to the electric-discharge surf ace treatment method according to the third invention, a hard coating can be formed on the surface of a material to be treated.

In addition, according to the electric-discharge surface treatment method according to the fourth invention, a hard coating can be formed on the surface of a material to be treated.

In addition, when the electric-discharge surface treatment electrode according to the fifth invention is used for electric-discharge surface treatment, a hard coating can be formed on the surface of a material to be treated.

In addition, according to the electric-discharge surface treatment method according to the sixth invention, a hard coating can be formed on the surf ace of a material to be treated.

In addition according to the electric-discharge surface treatment apparatus according to the seventh invention, not only is it possible to eliminate a fear of fire, but also it is possible to form a hard coating on the surface of a material to be treated.

As described above, according to the present invention, there can be provided an electric-discharge surface treatment method for enhancing the hardness of a hard coating formed on a material to be treated; and an apparatus and an electrode for carrying out the method.

In addition, there can be also provide an electric-discharge surface treatment method which uses water carefree with fire; and an apparatus and an electrode for carrying out the method.

What is claimed:

1. An electric-discharge surface treatment method, comprising the steps of:

providing a compressed powder electrode obtained by compression-molding of metal powder, metal compound powder, or ceramic powder;

generating pulsed electric discharge between said electrode and a material to be treated in a treatment liquid; and forming a coating comprising an electrode material or a substance obtained by reaction of said electrode material in response to energy of said electric discharge on a surface of said material to be treated, wherein the electrode includes carbon or graphite powder, or a substance for producing carbon in response to the energy of electric discharge.

2. The electric-discharge surface treatment method according to claim 1, wherein said electrode includes titanium powder or a titanium compound.

3. The electric-discharge surface treatment method according to claim 1, wherein said treatment liquid is a hydrocarbon liquid.

4. An apparatus for electric-discharge surface treatment in which pulsed electric discharge is generated between an electrode and a material to be treated in a treatment liquid so that a coating comprising an electrode material or a substance obtained by reaction of said electrode material in response to energy of said electric discharge is formed on a surface of said material to be treated, wherein said electrode comprises a metal, a metal compound, or a mixture in which carbon or graphite powder, or a substance for producing carbon in response to energy of electric discharge mixed with a ceramic powder.

5. The apparatus for electric-discharge surface treatment according to claim 1, wherein said electrode includes titanium powder or a titanium compound.

6. The apparatus for electric-discharge surface treatment according to claim 4, wherein said treatment liquid is a hydrocarbon liquid.

7. An electric-discharge surface treatment method, comprising the steps of:

providing a compressed powder electrode obtained by compression-molding of metal powder, metal compound powder, or ceramic powder, or a metal electrode as an electrode;

generating pulsed electric discharge between said electrode and a material to be treated; and forming a coating including an electrode material or a substance obtained by reaction of said electrode material in response to energy of said electric discharge on a surface of said material to be treated, wherein the electrode includes carbon, graphite, or a substance for producing carbon in response to thermal energy of electric discharge.

8. An electric-discharge surface treatment method, comprising the steps of:

providing a compressed powder electrode obtained by compression-molding of metal powder, metal compound powder, or ceramic powder;

generating pulsed electric discharge between said electrode and a material to be treated in a treatment liquid; and forming a coating comprising an electrode material or a substance obtained by reaction of said electrode material in response to energy of said electric discharge on a surface of said material to be treated, wherein the electrode includes carbon or graphite powder, or a substance for producing carbon in response to energy of electric discharge; and said treatment liquid is water.

9. An electric-discharge surface treatment apparatus in which a compressed powder electrode obtained by compression-molding of metal powder, metal compound powder, or ceramic powder, or a metal electrode is used as an electrode, and pulsed electric discharge is generated between said electrode and a material to be treated so that a coating comprising an electrode material or a substance obtained by reaction of said electrode material in response to energy of said electric discharge is formed on a surface of said material to be treated, wherein said apparatus comprises: an electrode including carbon or graphite powder, or a substance for producing carbon in response to energy of electric discharge, mixed with said metal powder, metal compound powder, or ceramic powder; a power supply unit for generating pulsed electric discharge between said electrode and a material to be treated; and treatment liquid supply means for supplying water as a treatment liquid between said electrode and said material to be treated.

* * * * *